United States Patent [19]

Leslie

[11] Patent Number: 4,551,876

[45] Date of Patent: Nov. 12, 1985

[54] SHOE PATCH DEVICE AND METHOD OF PRESERVING AND REPAIRING SHOES

[76] Inventor: Dale R. Leslie, 2531 Crestview Dr., Newport Beach, Calif. 92663

[21] Appl. No.: 658,421

[22] Filed: Oct. 5, 1984

Related U.S. Application Data

[63] Continuation of Ser. No. 445,238, Nov. 29, 1982, abandoned.

[51] Int. Cl.[4] ..... A43B 13/22; A43B 13/12

[52] U.S. Cl. ..... 12/142 Q; 12/142 P; 36/72 R

[58] Field of Search ..... 36/72 R, 72 B, 73, 71.5, 36/114; 12/142 P, 142 Q

[56] References Cited

U.S. PATENT DOCUMENTS

| | | | |
|---|---|---|---|
| 2,747,303 | 5/1958 | Abrahams | 36/72 R |
| 3,497,972 | 3/1970 | Lyman | 36/72 R |
| 3,974,578 | 8/1976 | Oettinger et al. | 36/72 R |
| 4,134,220 | 1/1979 | Dassler | 36/114 |
| 4,166,328 | 9/1979 | Hamilton | 36/72 R |

FOREIGN PATENT DOCUMENTS

| | | | |
|---|---|---|---|
| 970153 | 1/1951 | France | 36/73 |
| 20089 | of 1892 | United Kingdom | 36/72 R |
| 280707 | 11/1927 | United Kingdom | 12/142 Q |

*Primary Examiner*—Henry S. Jaudon
*Assistant Examiner*—Steven N. Meyers
*Attorney, Agent, or Firm*—Hubbard, Stetina & Brunda

[57] ABSTRACT

A shoe patch device and method of preserving and repairing shoes is disclosed wherein a patch member fabricated of a thin, flexible and durable material is formed to be rapidly adhered to the sole and/or upper of the shoe. The patch member is formed in a suitable configuration and includes a plurality of V-shaped notches extending inwardly from its edges to permit the patch member to readily accommodate all shoe sizes and be positioned at differing locations upon the shoe. Due to the lightweight and flexible properties of the patch member, the function and wear characteristics of the shoe are not altered or impaired, nor is it necessary to disturb the original construction of the shoe to effectuate repair or preservation of the shoe.

5 Claims, 6 Drawing Figures

SHOE PATCH DEVICE AND METHOD OF PRESERVING AND REPAIRING SHOES

This application is a continuation, of application Ser. No. 445,238, filed Nov. 29, 1982, now abandoned.

BACKGROUND OF THE PRESENT INVENTION

The present invention relates to shoe patches and, more particularly, to an improved shoe patch device and method of preserving and/or repairing shoes.

In recent years, there has been a dramatic resurgence in public recognition of the benefits derived from routine physical fitness activities with a vast number of the general public currently engaging in routine sport related activities such as jogging, tennis, racketball, basketball, and aerobics. This public resurgence has prompted an increased demand for more sophisticated sport shoes such as tennis shoes and the like, which typically are fabricated having a rubber or urethane sole and a fabric upper which are integrally molded together during the manufacture process. Although these more sophisticated sport shoes have proven generally suitable for their intended use, they possess inherent deficiencies which have detracted from their overall acceptance by the public.

Foremost of these deficiencies has been their relatively high initial cost which has been prohibitive to a large portion of the purchasing public. Further, to obtain optimum performance characteristics, these more sophisticated sport shoes have typically been prone to rapid deterioration and wear during use, often-times having an effective wear life of only a few months. In addition, due to these sport shoes typically being fabricated having a unitary molded sole and upper construction, repair of the same has been difficult, if not impossible, even by professional shoe repair personnel.

Although these cost and wear deficiencies have been recognized to a limited extent in the prior art, the solutions to date have comprised either awkward repair shoe tip attachments such as that disclosed in U.S. Pat. No. 1,536,204 issued to Garonski and U.S. Pat. No. 990,295 issued to Rosenblum, jell-like compounds adapted to fill voids in the rubber or urethane sole of the shoes, or molded urethane toe pieces formed to repair the toe portion of a shoe such as the Eternal Toe$^{TM}$ product manufactured by Runners Products Incorporated of Montgomery, Alabama.

Such prior art shoe tip attachments have typically been inapplicable for installation on sport shoes or alternatively have required professional shoe repairmen in applying the same to the sport shoe. In contrast, the jell-like compounds of the prior art have been diffcult to apply and have proven effective only in repairing the urethane or rubber sole of the shoe. Similarly, the molded urethane toe devices have been limited to precise locations upon the toe of the sport shoe with no provisions made for allowing repair of other stress points on the shoe. Additionally, all of the prior art devices typically have impaired the function or playing characteristics of the shoe and have been available only for repair and not for the preservation of the sport shoe.

Thus, there exists a substantial need in the art for an improved shoe patch and method of repairing and/or preserving shoes which is low-cost, readily mountable to differing locations upon the sport shoe, and which does not alter the function or playing characteristics of the sport shoe.

SUMMARY OF THE PRESENT INVENTION

The present invention specifically addresses and alleviates the above-referenced need associated in the art by providing an improved shoe patch device and method of preserving and/or repairing sport shoes. More particularly, the present invention comprises a patch member fabricated of a thin, long-wearing material such as leather which is formed to fit tightly around differing portions of a sport shoe. The patch member preferably includes a plurality of V-shaped notches extending along its edges which permit the patch member to accommodate, i.e. conform, to all shoe sizes and designs.

The patch member is applied to the sport shoe by way of an adhesive such as contact cement, so as to be rigidly maintained upon the shoe in a desired position, typically coinciding with those areas of the shoe subject to or encountering excessive wear. Thus, the patch member may be easily applied to the shoe without disturbing the original shoe construction; and after installation, the effective life of the sport shoe may be extended for prolonged periods.

Due to the patch member being formed of a thin and readily flexible material, once applied to the shoe, the device does not alter the function or playing characteristics of the shoe. Further, the method of the present invention is specifically adapted for home installation thereby eliminating the need of professional shoe repair labor. Additionally, the present invention is specifically adapted to accommodate application to a sport shoe prior to actual wearing, so as to serve as a preventive barrier to wear.

DESCRIPTION OF THE DRAWINGS

These as well as other features of the present invention will become more apparent upon reference to the drawings, wherein.

DESCRIPTION OF THE PREFERRED EMBODIMENT

Figure 1:
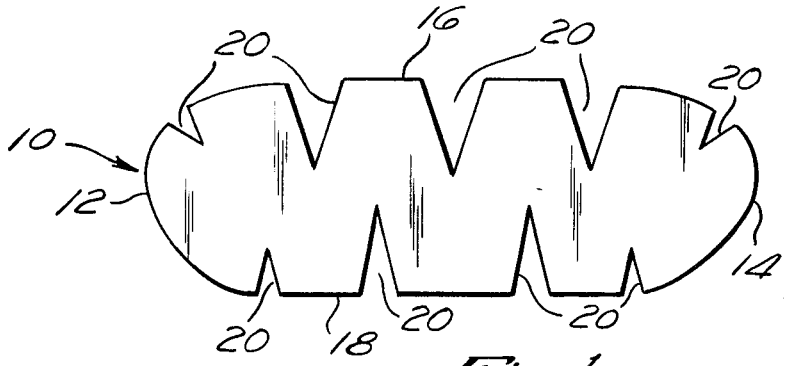
FIG. 1 is a top plan view of a first embodiment of the shoe patch member of the present invention.

Referring to FIG. 1, there is shown the shoe patch device or member 10 of the present invention. In the preferred embodiment, the patch member 10 is formed of a thin, readily flexible, and wear resistant material such as leather, having approximate dimensions of $5 \times 1\frac{1}{2} \times 1/16$ of an inch. Opposite ends 12 and 14 of the patch member 10 are preferably formed in a curvilinear configuration while the upper and lower edges 16 and 18, respectively, include a plurality of generally V-shaped notches or openings 20 which extend inwardly toward the center of the patch member 10. Due to the inclusion of the notches 20 and the configuration of the patch member 10, the patch member accommodates universal application to any design sport shoe as well as application to any location upon the sport shoe.

Figure 2:
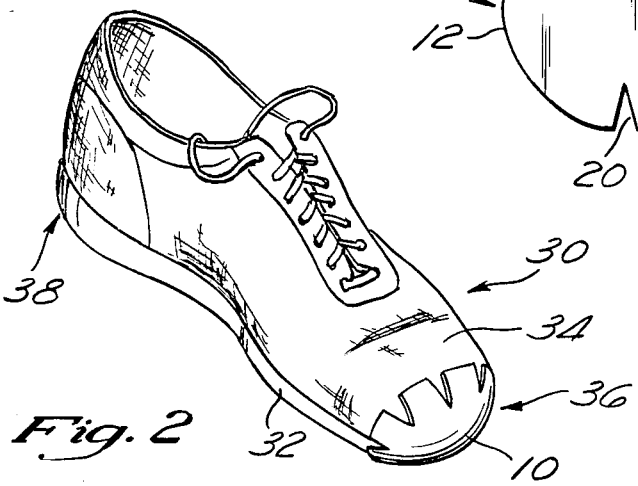
FIG. 2 is a perspective view showing the shoe patch member of the present invention applied to the toe portion of a sport shoe.
Figure 3:
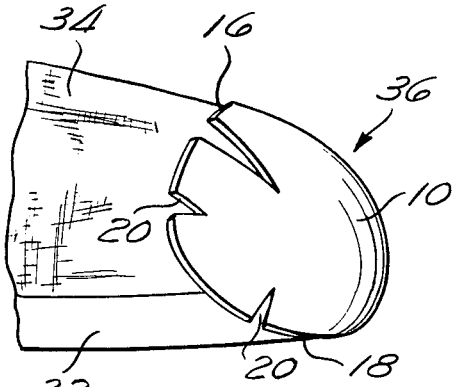
FIG. 3 is a partial perspective view of the shoe patch member of the present invention depicting its installation upon the toe of a sport shoe.

Referring to FIGS. 2 and 3, the application method of the patch member 10 of the present invention unto the shoe may be described. Although the patch member 10 may be applied to differing type shoe constructions, in the preferred embodiment, the patch member 10 is designed to be applied to sport shoes 30 which typically are not subject to repair by conventional shoe repair techniques.

For purposes of this application, the term sport shoe shall include all footwear designed for recreational use, most of which is characterized by a unified sole/upper shoe construction. The particular sport shoe 30 depicted in FIG. 2 comprises a conventional tennis shoe, having a sole 32 typically formed of a urethane or rubber material and a upper 34 formed of a fabric or leather material. As is well known, such sport shoes are subject to excessive wear or stress locations such as at the toe 36 or heel 38 which wear may be manifested either on the sole 32 or upper 34 or combination of both.

The initial step in the method of preserving or repairing the sports shoe 30 of the present invention is to designate the particular wear location on the shoe 30 for a particular user. For purposes of illustration, the wear location of the shoe 30 depicted in FIG. 2 comprises the toe portion 36 of the shoe 30 with the wear extending both upon the sole 32 and upper 36. With the wear location designated, the user applies a suitable adhesive to the undersurface of the patch member 10 as well as to the toe portion 36 of the sole and upper 32 and 34, respectively. The applicant has found that non-flammable contact cement is a preferred adhesive in that it provides suitable grip strength and flexibility on rubber, urethane, fabric and/or leather materials.

Subsequently, the user preliminary positions and presses the patch member 10 upon the toe portion 34 of the shoe 30 at the particular wear area with the bottom edge 18 of the patch member 10 preferably extending a short distance (i.e. approximately one-half of an inch) along the bottom of the sole 32. During this pressing operation, the lower portion of the patch member 10 conforms generally to the configuration of the sole 32. With the lower edge 18 attached to the sole 32, the user may subsequently press the remaining portion and upper edge 16 of the patch member 10 onto the upper 34 of the shoe 30 with the V-shaped notches 20 permitting the patch member 10 to tightly overlay the toe portion 36 in a generally contiguous orientation. When the application of the patch member 10 extends a short distance below the shoe 32 as well as greater distance upward onto the upper 34 of the shoe so as to provide a preventive barrier or repair area for the shoe 30.

Due to the patch member being formed of a durable material such as leather, the patch member 10 significantly increases the wear life of the shoe 30 in a manner which does not disturb the original construction of the shoe. The particular contact cement adhesive utilized in the present invention allows the patch member 10 to adhere to all of the different materials of the shoe 30 with sufficient strength so as to remain secured during wear as well as in combination with the light weight and high flexibility properties of the patch member 10 permits sufficient flexibility so as not to disturb the original function or playing characteristics of the shoe. Further, after significant wear has developed on the patch member 10, the particular adhesive advantageously does not provide such a permanent bond that the patch member 10 cannot be manually pulled off the shoe so as to permit later removal of the worn patch member 10 and re-application with an additional patch member 10.

Figure 4:
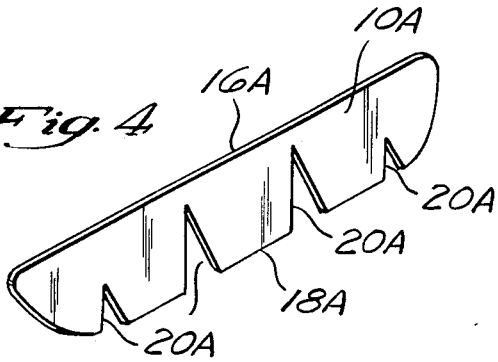
FIG. 4 is a perspective view of an additional embodiment of the shoe patch member of the present invention.

In FIG. 4, an additional embodiment 10A of the patch member of the present invention is disclosed which is more suitable for the preservation or repair of small wear locations upon the shoe 30. This additional embodiment of the patch member 10A is substantially the same as the embodiment 10 of FIG. 1 through 3 except that the width of the patch member 10A is approximately one-half size. In addition, the upper edge 16A of the patch member 10A preferably does not include the plural V-shaped notches 20A which are formed on the lower edge 18A of the member 10A.

Figure 5:
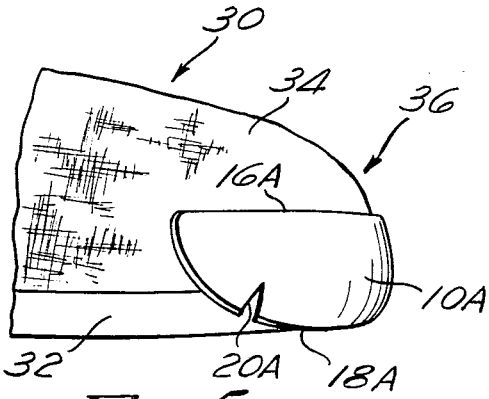
FIG. 5 is a partial perspective view showing the installation of the additional embodiment of the shoe patch member of the present invention upon the toe of a sport shoe.
Figure 6:
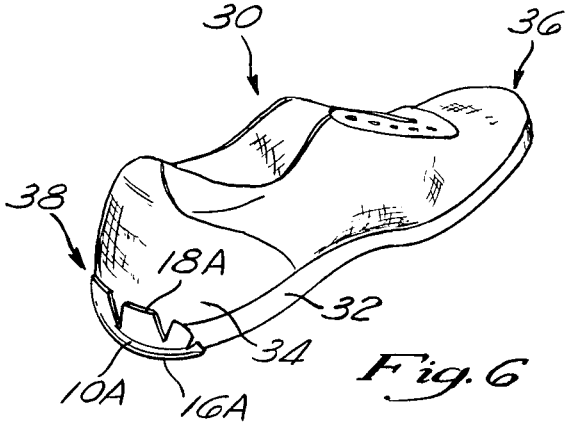
FIG. 6 is a perspective view showing the additional embodiment of the shoe patch member applied to the heel of a sport shoe.

The application of the patch member 10A upon the sport shoe 30 is depicted in FIGS. 5 and 6 and illustrates the universal application of the patch member 10A to differing locations upon the sport shoe 30. In FIG. 5, it will be seen that the patch member 10A may be applied to the toe portion 36 of the shoe 30 in the manner previously described. However, in this additional embodiment of the patch member 10A, it will be seen that the patch member 10A does not extend as far upward upon the upper 34 of the shoe 30. In FIG. 6, it will be seen that the patch member 10A may additionally be positioned on the heel portion 38 of the shoe and further may be inverted such that the edge 18A resides on the upper 34 of the shoe.

Thus in summary, it will be recognized that the present invention comprises a low-cost shoe patch member and method of preserving or repairing sport shoes which may be applied to the shoe without skilled labor and without disturbing the original construction of the shoe, permits universal application to all areas to the sport shoe, and once applied, does not alter or adversely affect the playing characteristics of the shoe. Although for purposes of description certain materials and material sizes have been defined, those skilled in the art will recognize that modifications to the same may be readily made and such modifications are clearly contemplated within the spirit of the present invention.

What is claimed is:

1. A method for preserving an unworn sport shoe without impairing the flexibility thereof, comprising the steps of:

designating any localized area on the sides or upper portion of said unworn sport shoe subject to excessive wear;

selecting a thin generally planar patch member having notched edges and fabricated of sufficiently flexible, wear resistant material which conforms exactly to the shape of said localized area in a size sufficient to extend over said localized area of said unworn sport shoe;

applying an adhesive to one side of said patch member and to said localized area; and pressing said one side of said patch member onto said localized area to conform the patch member to the shape of the localized area and to affix said patch member in a generally contiguous orientation to said unworn sport shoe to protect said localized area against wear without impairing the original playing characteristics, flexibility, and, construction of said unworn sport shoe.

2. The method of claim 1 wherein said adhesive applying step comprises applying a contact cement to one side of said patch member and said localized area of said unworn sport shoe.

3. The method of claim 2, wherein said pressing step comprises the further step of manually confirming said patch member to the configuration of said unworn sport shoe at said localized area of said sport shoe.

4. The method of claim 1, comprising the further steps of:

removing said patch member from said localized area after said patch member becomes worn but prior to said localized area of said unworn shoe becoming worn; and repeating said selecting, applying and pressing steps to further extend the wearability of said unworn sport shoe.

5. The method of claim 1, wherein the designating step includes designating a portion of the unworn sport shoe to sidewall.

* * * * *